United States Patent [19]

Denham et al.

[11] Patent Number: 5,035,129

[45] Date of Patent: Jul. 30, 1991

[54] REPETITION RIVETING APPARATUS

[75] Inventors: Keith Denham, Welwyn; Aiden R. Dear, Stotfold, Nr. Hitchin, both of England

[73] Assignee: Avdel Systems Limited, Welwyn Garden City, England

[21] Appl. No.: 554,450

[22] Filed: Jul. 19, 1990

[30] Foreign Application Priority Data

Jul. 21, 1989 [GB] United Kingdom ..... 8916702

[51] Int. Cl.[5] ..... B21J 15/18

[52] U.S. Cl. ..... 72/30; 72/33; 72/391.6; 29/243.523

[58] Field of Search ..... 29/243.521, 243.524, 29/243.525, 243.523; 72/391.2, 391.4, 391.6, 30, 10, 3, 4, 33; 227/156

[56] References Cited

U.S. PATENT DOCUMENTS

| | | | |
|---|---|---|---|
| 3,557,597 | 1/1971 | Heslop et al. | 72/391 |
| 3,820,603 | 8/1974 | Sheffield et al. | 72/391.6 |
| 3,892,120 | 7/1975 | Sheffield et al. | 72/391.6 |
| 4,368,838 | 1/1983 | Sheffield et al. | 72/391.6 |

*Primary Examiner*—David Jones

*Attorney, Agent, or Firm*—Oblon, Spivak, McClelland, Maier & Neustadt

[57] ABSTRACT

Repetition pull-through blind riveting apparatus (10), of the type comprising a reusable and reloadable mandrel with an enlarged head which is pulled through each tubular rivet in turn to install the rivet is provided with a safety device (141) for counting the total number of times the mandrel has been pulled. The apparatus includes pneumatically-operated mandrel pulling device, and a counter (132) counts the number of times the pressure of the air powering the pulling device reaches a pressure slightly below that required to pull the mandrel head through a rivet. The counter (132) is arranged to actuate, when a safe limit number of pulls has been counted, both a shut-off valve (137) to shut-off the supply of pressure air to the mandrel pulling device, and a visual indicator (135). The visual indicator (135) may be actuated at a warning count number rather lower than the safe limit number. The counter (132) can be reset to zero only by use of a separate key (142), when a new mandrel is installed in the rivet placing apparatus.

7 Claims, 3 Drawing Sheets

REPETITION RIVETING APPARATUS

The invention relates to repetition riveting apparatus for installing a plurality of rivets in succession. Such apparatus comprises a body, a reusable mandrel having an enlarged head, and pulling means for pulling the mandrel with respect to the body to pull the mandrel head through a tubular rivet which is supported by the body. The passage of the enlarged mandrel head through the tubular rivet deforms the rivet by radially enlarging at least part of it, thereby to install it in a workpiece in which it has been inserted.

Such repetition riveting apparatus, and rivets for use therewith, have been well known for many years under the Registered Trade Marks CHOBERT and BRIV.

Although the total number of rivets which can be loaded onto a mandrel at one time for successive installation may be, for example, typically between twenty and forty rivets, such a mandrel is reusable to install a substantially greater number of rivets, for example, 5000 rivets, by means of repeated reloading of the same mandrel. However, the repeated passage of the mandrel head through the bores of a large number of rivets causes wear of the mandrel head, producing a slight progressive reduction in the diameter of the mandrel head. If the same mandrel is used to install an excessive number of rivets, the mandrel head diameter may fall below a certain critical size, in relation to the diameter of the bores of the tubular rivets. Thereafter the installed rivets may not be radially expanded sufficiently, and may not be installed properly. Such faulty installation may not be apparent at the time of installation, but may become apparent when the riveted joint is subject to stress. Such improper rivet installation is obviously undesirable.

The present invention seeks to overcome such problems.

It would be inconvenient to repeatedly measure and monitor the diameter mandrel head during continued use, especially under workshop conditions. However, it will normally be possible to determine a safe limit to the number of rivet installations which may be safely made by a mandrel without excessive wear occurring. This safe limit number will usually depend upon a number of factors, such as the relative hardness of the materials of the mandrel and the rivets which it is to install and the relative sizes of the mandrel head and rivet bore.

The invention provides, in one of its aspects, repetition riveting apparatus for installing a plurality of rivets in succession, which apparatus comprises:

a body;

a reusable mandrel having an enlarged head;

pulling means for pulling the mandrel with respect to the body to pull the mandrel head through a tubular rivet which is supported by the body;

counting means for counting the total number of times the pulling means has operated to pull the mandrel with respect to the body as aforesaid;

and warning means responsive to the counting means for giving a warning when the mandrel has been pulled a predetermined number of times.

The invention provides, in another of its aspects, repetition riveting apparatus for installing a plurality of rivets in succession, which apparatus comprises:

a body;

a reusable mandrel having an enlarged head;

pulling means for pulling the mandrel with respect to the body to pull the mandrel head through a tubular rivet which is supported by the body;

counting means for counting the total number of times the pulling means has operated to pull the mandrel with respect to the body as aforesaid;

and inhibiting means responsive to the counting means for inhibiting further operation of the pulling means when the mandrel has been pulled a predetermined number of times.

The invention provides, in another of its aspects, repetition riveting apparatus for installing a plurality of rivets in succession, which apparatus comprises:

a body;

a reusable mandrel having an enlarged head;

pulling means for pulling the mandrel with respect to the body to pull the mandrel head through a tubular rivet which is supported by the body;

counting means for counting the total number of times the pulling means has operated to pull the mandrel with respect to the body as aforesaid;

and warning means also responsive to the counting means for giving a warning when the mandrel has been pulled the aforesaid predetermined number of times.

The invention provides, in another of its aspects, repetition riveting apparatus for installing a plurality of rivets in succession, which apparatus comprises:

a body;

a reusable mandrel having an enlarged head;

pulling means for pulling the mandrel with respect to the body to pull the mandrel head through a tubular rivet which is supported by the body;

counting means for counting the total number of times the pulling means has operated to pull the mandrel with respect to the body as aforesaid;

warning means responsive to the counting means for giving a warning when the mandrel has been pulled a first predetermined number of times;

and inhibiting means responsive to the counting means for inhibiting further operation of the pulling means when the mandrel has been pulled a second predetermined number of times which is greater than the first predetermined number.

Preferably the apparatus further comprises resetting means for resetting the counting means. Preferably the resetting means is controlled by lock means, operable by separate key means, so that the key means may be kept separate from the rivet installation apparatus and used to allow resetting of the counter means only when a new mandrel is installed in the apparatus.

When the pulling means is pneumatically operated, preferably the apparatus includes pressure sensing means to sense when the pulling means operating pressure reaches a predetermined value, and the counting means is arranged to count the number of times the pressure sensing means senses the aforesaid predetermined value.

Two embodiments of the invention will now be described by way of example and with reference to the accompanying drawings, in which.

Figure 1:
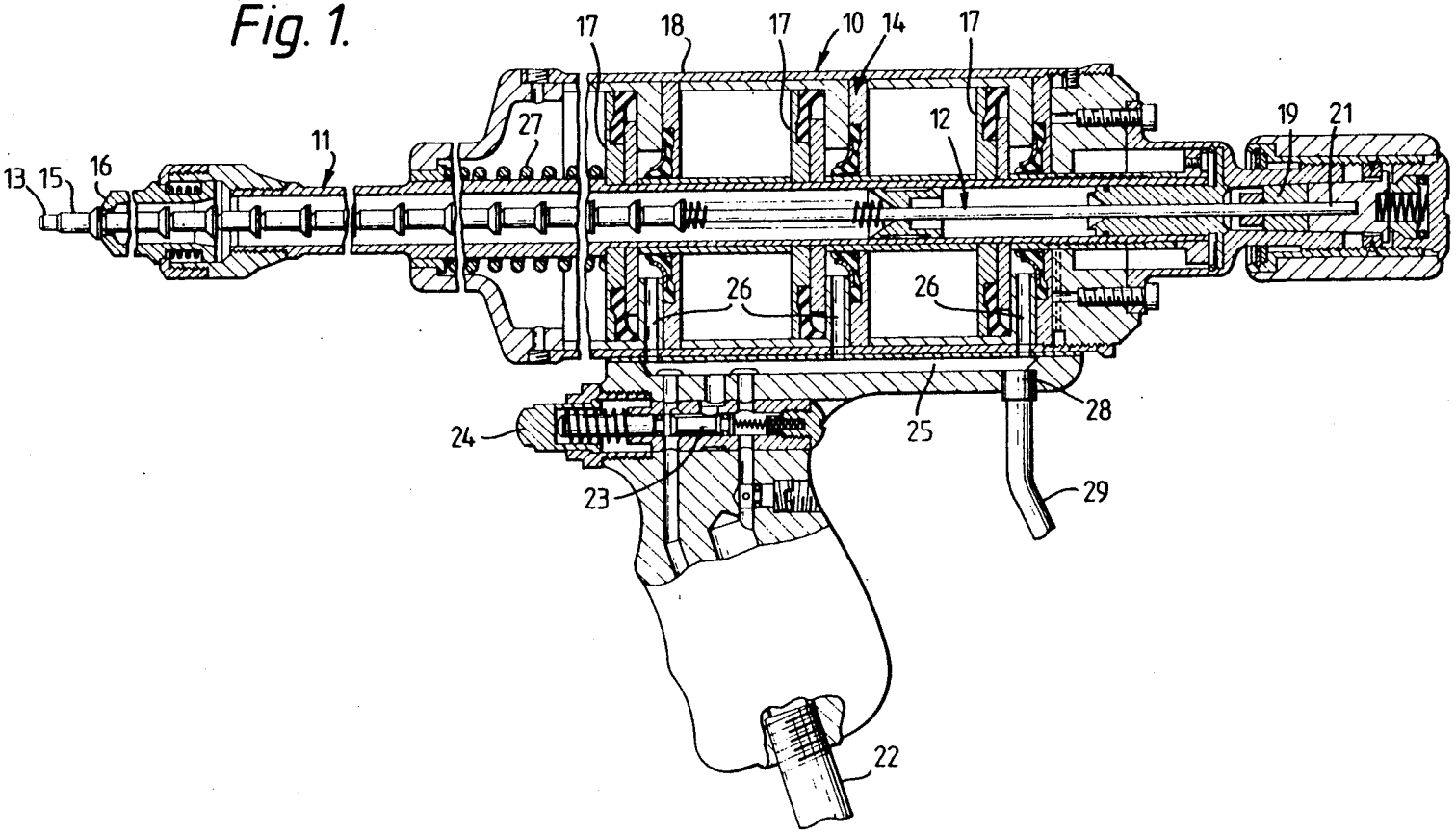
FIG. 1 is an axial section through a repetition rivet installation tool, adapted according to the present invention.

Referring first to FIG. 1 (in which some parts are shown broken away and foreshortened for ease of illustration), the repetition blind riveting tool 10 comprises essentially a body 11, a reusable mandrel 12 having an enlarged head 13, and pulling means comprising a multiple pneumatic piston and cylinder device 14 for pulling the mandrel with respect to the body, to pull the mandrel head 13 through a tubular rivet 15 supported by the body on a nosepiece 16 at its front end. The piston and cylinder device 14 has its pistons 17 carried on the rear portion of the body 11, within a common reciprocable cylinder 18 on the rear end of which are mounted tail jaws 19 which grip the tail end 21 of the mandrel, i.e. the end remote from the head 13. Compressed air is supplied to the tool by a flexible hose 22 and through a trigger-operated valve 23. When the valve trigger 24 is pressed, the valve 23 opens and compressed air is admitted along a passage 25 outside the cylinder 18 and then through cross passages 26 into the multiple cylinder 18. The compressed air forces the cylinder 18 backwards along the body 11, pulling the mandrel 12 with it, and pulling the mandrel head 13 through the tubular rivet 15 against the reaction provided by the nosepiece 16 of the body 11. When the trigger 24 is released, the passage 25 and interior of the cylinder 18 is shut off from the compressed air feed and is vented to atmosphere. The cylinder 18 and mandrel 12 return forwardly, under the urging of a return spring 27, also feeding a further rivet forwardly through the nosepiece 16.

When all the rivets carried on the mandrel 12 have been installed, the tool can be reloaded by unlocking the tail jaws 19, withdrawing the mandrel 12 through the nosepiece 16, loading a further supply of rivets on it, re-inserting it through the nosepiece 16 until its tail end 21 is within the tail jaws 19, and re-locking the tail jaws 19. In this way the same mandrel 12 can be used and re-used to install a substantial number of rivets.

The tool and its manner of use, as described above, are well known in the art of blind riveting.

This tool is adapted for use in riveting apparatus according to the present invention by the addition of an air connection 28 which connects the air feed passage 25 to a small diameter flexible pipe 29. This connection enables the operating air pressure inside the pneumatic piston and cylinder device 14 to be sensed by the further parts of the apparatus, which are illustrated in FIGS. 2 and 3, to which reference will now be made.

Figure 2:
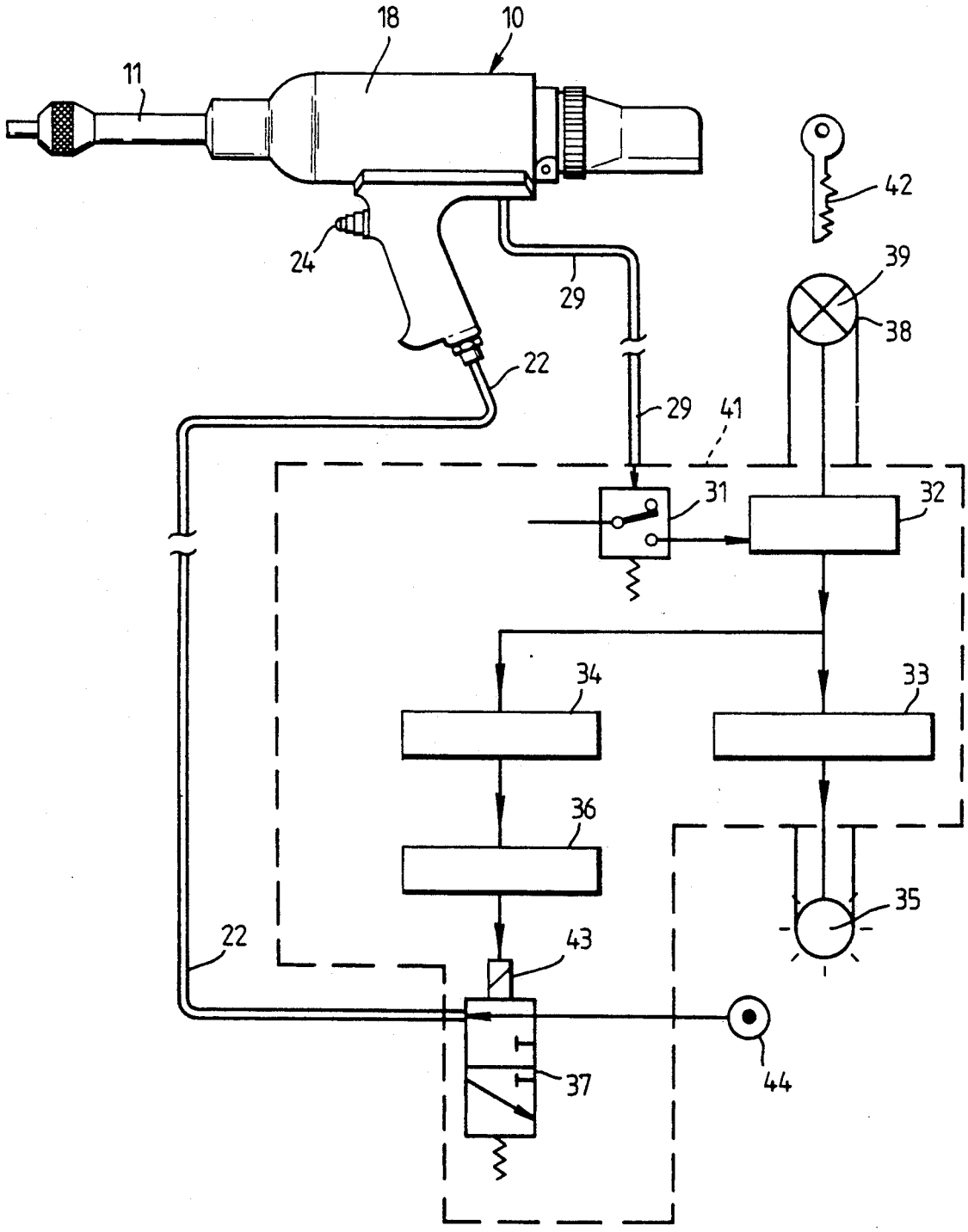
FIG. 2 is a block schematic diagram of rivet installation apparatus according to the present invention, incorporating the tool of FIG. 1.
Figure 3:
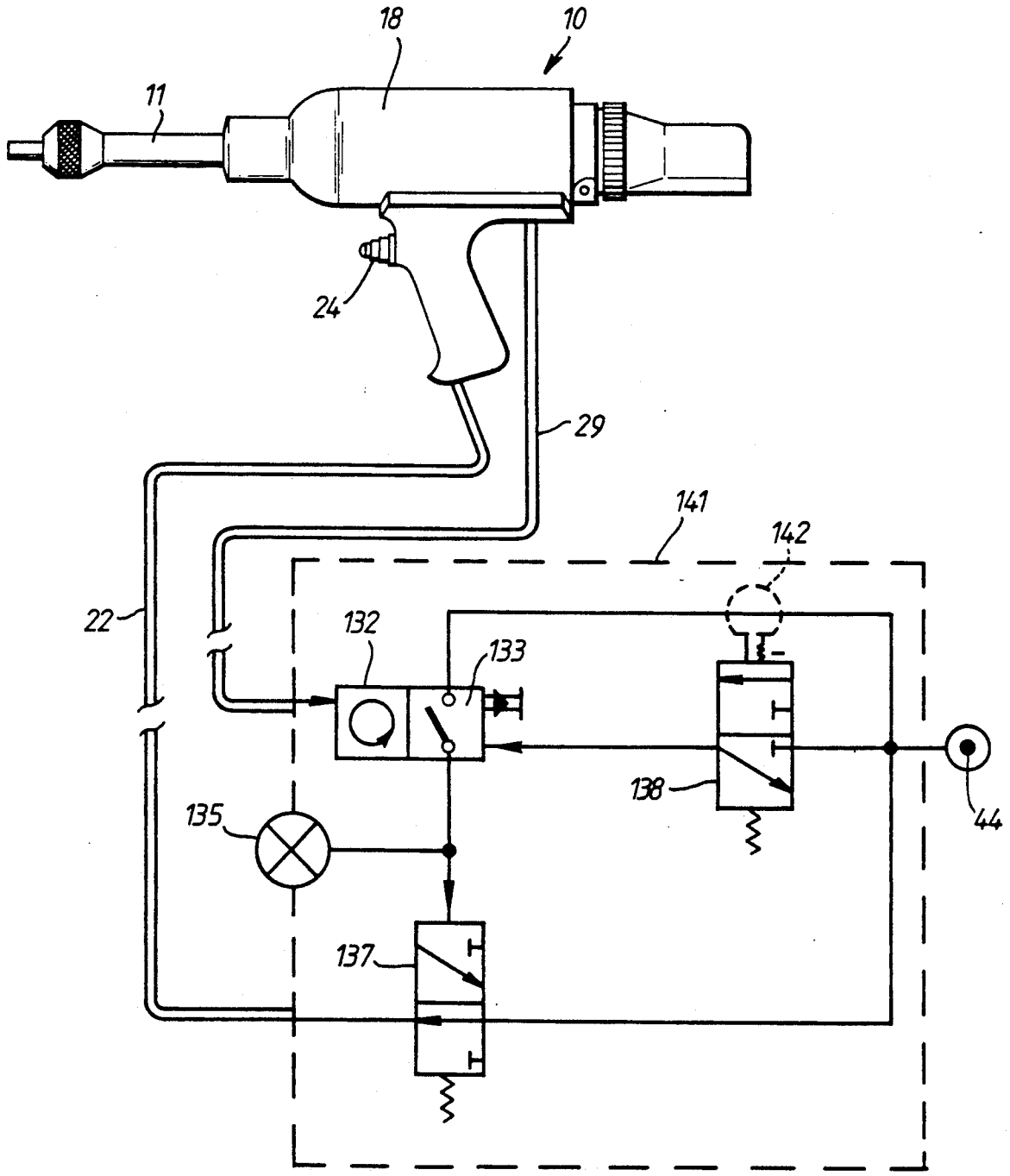
FIG. 3 is a similar block schematic diagram of apparatus which is a modification of that illustrated on FIG. 2.

Referring to FIG. 2, the apparatus also comprises a control unit 41 to which the installation tool 10 is connected by means of the air pressure hose 22 and the flexible pipe 29. The control unit comprises a pressure sensitive switch 31 connected to the flexible pipe 29 to sense the operating air pressure inside the tool cylinder. It further comprises counting means comprising an electronic counter 32, a first number store and comparator 33, and a second number store and comparator 34. It further comprises a warning light 35 connected to the first comparator 33, a relay 36 connected to the second comparator 34, and spring biassed air shut-off valve 37 controlled by the second comparator 34 through the relay 36. The air supply hose 22 to the tool is connected via the shut-off valve 37 to a compressed air inlet connection 44. The control unit also comprises a keyswitch 38 for resetting the counter 32, the keyswitch comprising a lock 39 which is housed in the same cabinet as the remainder of the control unit 41, and a separate key 42.

When the trigger 24 on the tool is pressed to open the valve 23, compressed air is fed to the piston and cylinder device 14. However, due to the resistance to flow of air along the passages inside the tool, the pressure inside the cylinder 18 does not immediately reach full line pressure (i.e. the maximum pressure available from the air line source). Instead, the pressure progressively increases. As the pressure increases, the piston moves under the influence of the pressure on one side of it, opposed by the forces due to the compression of the return spring 27 and the force required to pull the mandrel head 13 through the tubular rivet 15 and expand the latter radially. Thus, while the valve 23 is open, the operating air pressure of the pneumatic piston and cylinder device 14 of the mandrel pulling means progressively increases. This pressure is sensed by the pressure sensitive switch 31. The pressure sensitive element of this switch is adjusted so that the switch closes at a predetermined pressure which is slightly below that which will be reached when the mandrel head 13 is pulled through the rivet 15. Thus, every time the pressure sensitive switch 31 senses that the predetermined pressure is reached, it sends an electrical signal to the counter 32. The maximum pressure reached while installing a rivet may vary slightly from rivet to rivet due to dimensional variations within tolerance between different rivets, and the predetermined pressure is set just below this range.

The counter 32 feeds, to both the first and second number store and comparator devices 33 and 34, an electrical signal representing the count number reached by the counter 32. The second device 34 is preset with a predetermined number (the "limit" number) which is the number of rivet installations which the mandrel 12 can safely make. As long as the count number in the counter 32 is less than the predetermined "limit" number preset in the comparator 34, the comparator 34 controls the relay 36 to energize the solenoid 43 to hold the valve 37 open against its spring biasing, thus supplying air to operate the installation tool 10. When the count number in the counter 32 equals the predetermined limit number in the comparator 34, the comparator 34 controls the relay 36 to de-energize the solenoid 43, thus allowing the valve 37 to shut under its spring biasing, and prevent further use of the tool 10.

Similarly, the first comparator device 33 is preset with a predetermined number (the "warning" number) which is somewhat lower than the predetermined "limit" number preset in the second comparator 34. As long as the count number in the counter 32 is less than the "warning" number preset in the comparator 33, the warning lamp 35 remains switched off. When the count number in the counter 32 is equal to or greater than the "warning" number, the comparator 33 switches on the warning lamp 35 (may be via a relay device).

The counter 32 can be reset to zero only through the operation of the lock 39 of the keyswitch 38, which is operable only by the matching key 42. The counter 32 is reset to zero only when a new mandrel 12 is fitted to the tool.

The operation of the system is as follows.

As previously described, the second comparator 34 is preset with a "limit" number which is the number of rivet installation operations which the mandrel 12 can safely make. The comparator 33 is preset with a "warning" number which is sufficiently below the "limit"

number to give the tool operator a reasonable advance warning that a mandrel change will soon be necessary. This will enable the operator, for example, to avoid starting installing rivets on a further workpiece during which process the "limit" number will be reached and the tool automatically shut off.

A new mandrel 12 is fitted to the tool, and the counter 32 reset to zero by use of the key 42. The tool is used to install rivets, each rivet installation causing the counter 32 to increment by one. Thus the counter counts the total number of times the pulling means has operated to pull the mandrel since the mandrel was installed in the tool. Operation of the tool continues until the "warning" number of installations is reached, when the warning lamp 35 is illuminated to warn the operator that the "limit" number is being approached. When the number of rivet installations reaches the "limit" number, which is the safe number for the mandrel, the shut-off valve 37 closes and prevents further use of the tool. The used mandrel is released from the tool in the way described with reference to reloading the mandrel, and is disposed of.

The electronic circuitry of the control unit may be implemented in any convenient way. It will normally ensure that the "warning" and "limit" numbers, preset in the comparators 33 and 34, cannot be altered by the tool operator or any other unauthorized person. The lock and key may be an electronic device instead of a mechanical device.

In the modified form of apparatus shown in FIG. 3, the control unit 141 does not incorporate any electrical or electronic devices, but is completely pneumatically operated, thus avoiding the need to provide electrical power, as well as pneumatic power, to the control unit. In this modified form of control unit, the pressure sensitive switch 31, counter 32, and number store and comparator 33 are replaced by a single pneumatically actuated counter 132 incorporating a normally-closed valve 133. The electric warning lamp 35 is replaced by a pneumatically-actuated visual indicator 135, which when actuated reveals a highly reflective coloured element. Under normal ambient lighting conditions under which the apparatus will be used, this gives a readily visible warning. The shut-off valve 137 is pneumatically actuated instead of electrically actuated. The counter 132 is reset to zero by a pneumatic reset pulse applied via a key-operated reset valve 138, operated by a key 142.

In use of the apparatus incorporating this control unit, the counter 132 is set to zero (when a new mandrel is inserted in the tool 10) by operation of the key-operated reset valve 138, which applies a reset pneumatic pulse to the counter 132. When the count on the counter is less than its predetermined "limit" value, the valve 133 is open. The counter 132 counts the number of times the mandrel is pulled. When the count reaches the predetermined "limit" value, the counter 132 opens the valve 133. This feeds pressure air to the spool of the shut-of valve 137, to actuate it to shut-off the air supply to the tool 10. At the same time it allows pressure air to actuate the visual warning device 135 to indicate visually that the safe "limit" value has been reached.

In both forms of control unit, the provision of a separate resetting key 42 or 142 enables the key to be kept not available to the tool operator, but held by some other person, who will use the key to reset the counter to zero only when a new mandrel is fitted to the tool. When the counter 32 or 132 is reset to zero, the valve 37 or 137 is opened again and the warning light 35 or visual indicator 135 is switched off again.

Thus in the apparatus of the foregoing examples, the counting means counts the total number of times the pulling means operates to pull the mandrel with respect to the body, regardless of reloading of the mandrel. The counting means is not reset to zero each time the mandrel is reloaded with rivets.

If the tool trigger is pressed when there is no rivet 15 between the mandrel head 13 and the nosepiece 16, the piston and cylinder device will be actuated and will reach the limit of its travel, causing its internal air pressure to reach the value preset on the pressure sensitive switch 31 and thus giving an additional spurious count. However such spurious counts are on the safe side, since the mandrel will have actually been used to install less rivets than counted by the counter 32 or 132.

It is believed that the apparatus described above, whether electro-pneumatic or all pneumatic, should ensure that a mandrel is not used to install more rivets than the safe "limit" number.

The invention is not restricted to the details of the foregoing example. For instance, the apparatus may be provided with a numerical counter display device, which displays the count number held in the counter 32 or 132, and/or the number of rivet installation operations remaining until the "limit" number is reached.

We claim:

1. Repetition riveting apparatus for installing a plurality of rivets in succession, which apparatus comprises:
- a body;
- a reusable mandrel having an enlarged head;
- pulling means for pulling the mandrel with respect to the body to pull the mandrel head through a tubular rivet which is supported by the body;
- counting means for counting the total number of times the pulling means has operated to pull the mandrel with respect to the body as aforesaid;
- and warning means responsive to the counting means for giving a warning when the mandrel has been pulled a predetermined number of times.

2. Repetition riveting apparatus for installing a plurality of rivets in succession, which apparatus comprises:
- a body;
- a reusable mandrel having an enlarged head;
- pulling means for pulling the mandrel with respect to the body to pull the mandrel head through a tubular rivet which is supported by the body;
- counting means for counting the total number of times the pulling means has operated to pull the mandrel with respect to the body as aforesaid;
- and inhibiting means responsive to the counting means for inhibiting further operation of the pulling means when the mandrel has been pulled a predetermined number of times.

3. Repetition riveting apparatus for installing a plurality of rivets in succession, which apparatus comprises:
- a body;
- a reusable mandrel having an enlarged head;
- pulling means for pulling the mandrel with respect to the body to pull the mandrel head through a tubular rivet which is supported by the body;
- counting means for counting the total number of times the pulling means has operated to pull the mandrel with respect to the body as aforesaid;
- inhibiting means responsive to the counting means for inhibiting further operation of the pulling means when the mandrel has been pulled a predetermined number of times;

and warning means also responsive to the counting means for giving a warning when the mandrel has been pulled the aforesaid predetermined number of times.

4. Repetition riveting apparatus for installing a plurality of rivets in succession, which apparatus comprises:

a body;

a reusable mandrel having an enlarged head;

pulling means for pulling the mandrel with respect to the body to pull the mandrel head through a tubular rivet which is supported by the body;

counting means for counting the total number of times the pulling means has operated to pull the mandrel with respect to the body as aforesaid;

warning means responsive to the counting means for giving a warning when the mandrel has been pulled a first predetermined number of times;

and inhibiting means responsive to the counting means for inhibiting further operation of the pulling means when the mandrel has been pulled a second predetermined number of times which is greater than the first predetermined number.

5. Apparatus as claimed in any of claims 1 to 4, further comprising resetting means for resetting the counting means.

6. Apparatus as claimed in claim 5, in which the resetting means is controlled by lock means, operable by separate key means, so that the key means may be kept separate from the rivet installation apparatus and used to allow resetting of the counter means only when a new mandrel is installed in the apparatus.

7. Apparatus as claimed in any one of claims 1, 2, 3, 4 or 6, in which the pulling means is pneumatically operated, which apparatus includes pressure sensing means to sense when the pulling means operating pressure reaches a predetermined value, and in which the counting means is arranged to count the number of times the pressure sensing means senses the aforesaid predetermined value.

* * * * *